United States Patent [19]

Weaving et al.

[11] 3,958,312

[45] May 25, 1976

[54] CATALYTIC DEVICE FOR AN EXHAUST SYSTEM FOR AN INTERNAL COMBUSTION ENGINE

[75] Inventors: John Harold Weaving, Solihull; Cecil David Haynes, Nuneaton; John Edward Caulton, Wolverhampton, all of England

[73] Assignee: British Leyland Motor Corporation Limited, London, England

[22] Filed: Jan. 18, 1974

[21] Appl. No.: 434,542

[52] U.S. Cl. ..... 29/157 R; 23/288 FC; 29/446; 29/455 LM

[51] Int. Cl.[2] ..... B01J 8/02; B21D 39/02; B23P 15/26; F01N 3/15

[58] Field of Search ..... 23/288 FC; 29/157 R, 29/446, 451, 452, 455; 138/112, 115, 146, 147, 149; 60/299, 301

[56] References Cited

UNITED STATES PATENTS

| | | | |
|---|---|---|---|
| 1,948,564 | 2/1934 | Cornell, Jr. | 29/157 R |
| 2,372,723 | 4/1945 | Jasper | 29/446 |
| 2,635,330 | 4/1953 | Fentress | 29/455 |
| 3,000,433 | 9/1961 | Kemper | 138/147 |
| 3,100,140 | 8/1963 | Ashley et al. | 23/288 FC UX |
| 3,109,259 | 11/1963 | Viall | 29/452 |
| 3,189,418 | 6/1965 | Gary | 23/288 FC UX |
| 3,216,079 | 11/1965 | Keyworth | 29/452 |
| 3,233,697 | 2/1966 | Slayter et al. | 23/288 FC UX |
| 3,233,699 | 2/1966 | Plummer | 138/149 |
| 3,774,281 | 11/1973 | Eliason | 29/157 |
| 3,787,944 | 1/1974 | Mittman | 29/451 |
| 3,798,006 | 3/1974 | Balluff | 23/288 FC |

*Primary Examiner*—Morris O. Wolk
*Assistant Examiner*—Michael S. Marcus
*Attorney, Agent, or Firm*—Brisebois & Kruger

[57] ABSTRACT

A catalytic device for an internal combustion engine comprises a unitary refractory catalyst support surrounded by a combined thermal insulating and shock absorbing layer in turn closely surrounded by a gas impervious casing. A number of methods are disclosed of securing the layered support to the impervious casing.

4 Claims, 7 Drawing Figures

CATALYTIC DEVICE FOR AN EXHAUST SYSTEM FOR AN INTERNAL COMBUSTION ENGINE

This invention relates to a catalytic device for an exhaust system for an internal combustion engine and to a method of fabricating such a device.

The exhaust gases of internal combustion engines contain varying amounts of carbon monoxide, unburnt hydrocarbons, nitric oxide and particulate matter which contribute to air pollution and particularly to the generation of smog in areas of strong sunlight which has a photochemical effect. Many methods have been evolved, and great efforts have been made, to reduce or eliminate noxious constituents of the exhaust gas. One known device is of the type which is usually known as a catalytic reactor and which provides for the conduction of exhaust gases over a suitable chemical catalyst so that the noxious products are oxidised or reduced to harmless products to a greater or lesser extent. The disadvantage of such devices is that the life of the catalysts are limited by several factors. A catalyst, to be effective, must have a large area to which the exhaust gases may gain access and most catalysts are supported on a material that is porous and allows the exhaust gases to permeate or diffuse into its depth. Such catalysts are often in pellet or spherical form. These catalysts frequently deteriorate by sintering due to overheating in which case the porous nature of the catalyst becomes greatly reduced. Alternatively, they become plugged or de-activated by particulate matter contained in the exhaust gas, making it difficult for the gas to reach the catalytic sites.

According to a first aspect of the present invention a catalytic device for an exhaust system for an internal combustion engine comprises:

a unitary refractory catalyst support member;

a casing for the support member impervious to the exhaust gases and adapted to encase the support member by way of a thermal insulating layer between support member and casing, the layer being adapted to attenuate the effect on the support member of mechanical shock sustained by the casing;

the casing acting by way of the insulating layer to maintain the support member in compression at least at normal working temperatures.

According to a second aspect of the present invention a method of fabricating a catalytic device for an exhaust system for an internal combustion engine comprises the steps of:

1. disposing a layer of thermal insulating material about the periphery of a unitary refractory catalyst support member;
2. wrapping around the member and the layer a sheet of casing material;
3. tensioning the sheet around the member to compress the layer substantially uniformly; and
4. securing the sheet to itself to provide a gas tight enclosure about the member.

According to a third aspect of the present invention a method of fabricating a catalytic device for an exhaust system for an internal combustion engine comprises the steps of:

1. disposing a layer of thermal insulating material about the periphery of a unitary refractory catalyst support member;

2. mounting the layered support member within a corrugated component which is mounted within a rigid body shell; and
3. distorting the corrugated component to cause it to expand to contact the layered support member and the shell so as to grip and locate the layered support member within the shell member.

Embodiments of the invention will now be described with reference to the accompanying drawings of which:

Figure 1:
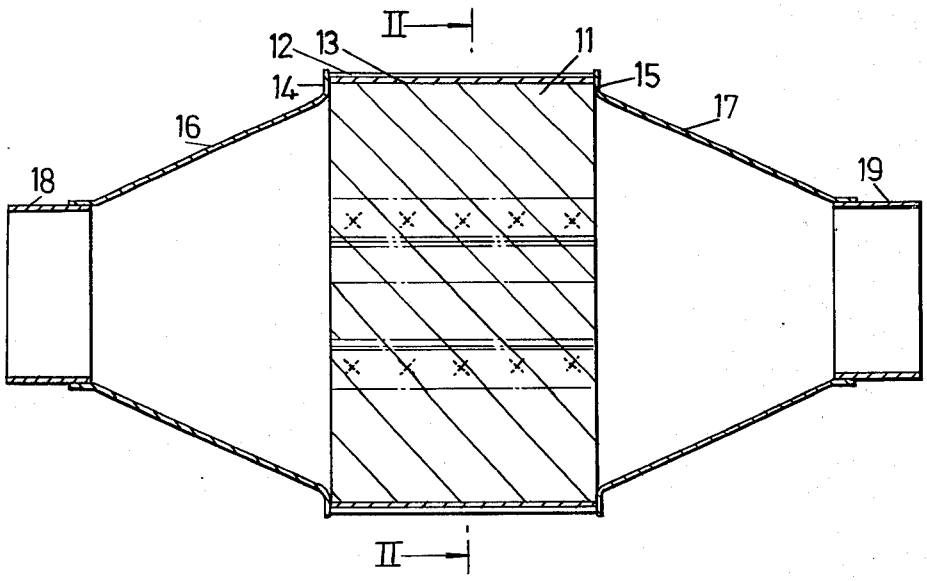
FIG. 1 is a sectioned elevation of a catalytic device comprising an embodiment of the first aspect of the invention.
Figure 2:
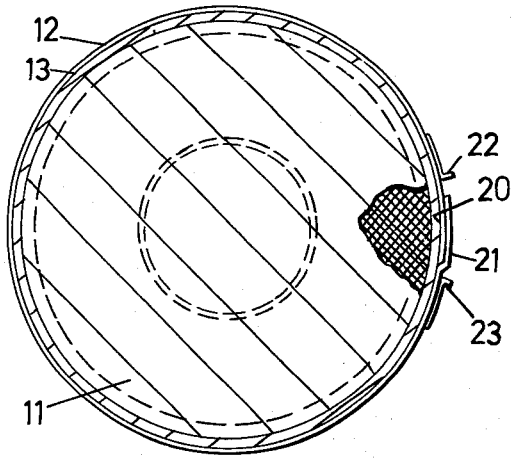
FIG. 2 is a cross-sectional view on section II—II of FIG. 1.

FIGS. 1 and 2 show a catalytic device in which a unitary refractory catalyst support member 11 permeable by exhaust gas is mounted in a stainless steel casing 12. Space 13 between member 11 and casing 12 is filled by a proprietary thermal insulating material known as Fiberfrax. The support member is of ceramic material having interstitial passages extending through it whereby exhaust gas can pass through the block in intimate contact with catalytic material deposited on the wall of the interstitial passages. The catalytic material serves to promote gas reactions which result in noxious products being oxidised or reduced to harmless products to a greater or lesser extent. The member 11 is axially located, relative to longitudinal axis 12 of the casing 12, by way of outturned flanges 14, 15 of, respectively, end cones 16, 17. Cones 16, 17 are welded to, respectively, inlet tube 18 and outlet tube 19. In operation exhaust gases enter the device by way of inlet tube 18, pass through support member 11 and leave by way of outlet tube 19.

To fabricate the device shown in FIGS. 1 and 2 the support member 11 is coated with the Fiberfrax material. The casing 12 is then wrapped around the member 11 and flanges 20, 21 of the casing are allowed to overlap. Brackets 22, 23 welded to the casing material are then urged towards one another by loads applied tangentially to the member 11. With the casing wrapped to a suitable tension around the coated member 11 to compress said layer substantially uniformly the flanges 20, 21 are tack welded to allow removal of loadings applied by way of brackets 22, 23. Thereafter the flanges 20, 21 are finally welded to provide a gas tight seal along the axial length of casing 12. In operation, at normal working temperatures, the casing 12 operates within the elastic limit to maintain support member 11 in compression by way of flanges 14, 15.

FIGS. 3 to 6 show a number of methods by means of which a casing C is wrapped round a catalyst carrier member M. The member M has its outer periphery coated with a heat insulating material T.

Figure 3:
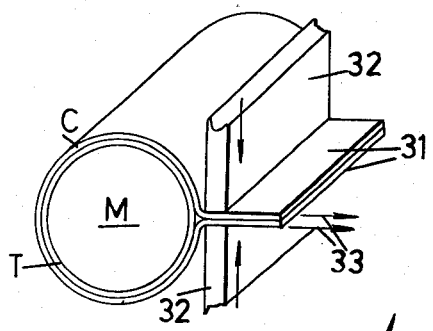
FIGS. 3 to 6 are cross-sectional views.

In FIG. 3 the casing material is of greater peripheral length than the coated member M and is provided with tails 31 which are squeezed together by tools 32 to fold the casing round the member. Simultaneously the tails 31 are drawn by a gripping tool in the direction of arrows 33 to tension the casing to give the required compression of the member M. When a suitable tension has been generated the seam in the vicinity of the tools 32 of the casing is welded up to provide a gas tight casing around the member. Thereafter the tools 32 are withdrawn and the surplus tail material is cut off prior to the encased member M being incorporated into a structure similar to that shown in FIGS. 1 and 2.

Figure 4:
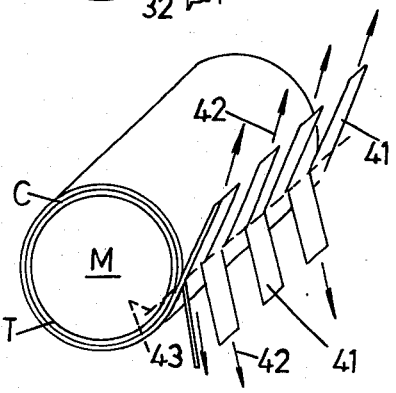

FIG. 4 shows an arrangement which the casing C has tails 41 which are castellated in an off-set manner from each other and interleaved to allow the tails to be pulled in the direction of arrows 42 to provide the requisite tension in the casing C and compression of the layer of insulating material. Thereafter the casing is welded along a longitudinal seem 43 to provide the necessary gas tight enclosure and the surplus material of the tails 41 is cut off.

Figure 5:
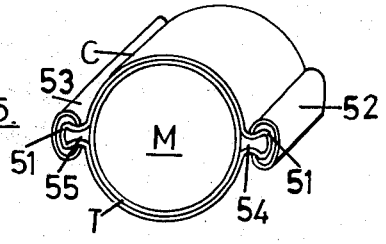

FIG. 5 shows a tubular casing C whose peripheral length is substantially greater than that of the coated member M. At diametrically opposed points on the casing ears 51 are formed and subsequently crushed to provide the requisite tension in the casing and compression of said layer of insulating material. In this case the loading is uniformly applied by spring clips 52, 53 which allow the ears to be welded up in the vicinity of the seams 54, 55. An incidental advantage of this arrangement is that the tensioning of the casing is applied equally on opposite sides of the casing rather, than as shown in FIGS. 3 and 4, taking place at only one point on the periphery of the casing.

Figure 6:
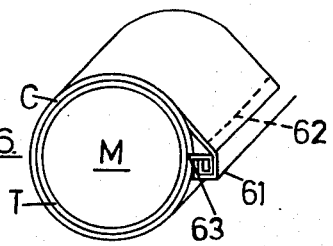

FIG. 6 shows a wrap around form of casing where the material of the casing has its axial edges welded to a square bar 61 which is thereafter twisted around its axis causing said sheet of casing material to wrap around the bar adjacent both of said axial edges of said casing material to increase the tension of the casing and compress the layer of insulating material and thereafter allow the contiguous edges 62, 63 of the casing to be welded under tension. Thereafter the square bar 61 with casing material twisted round it is cut free.

Figure 7:
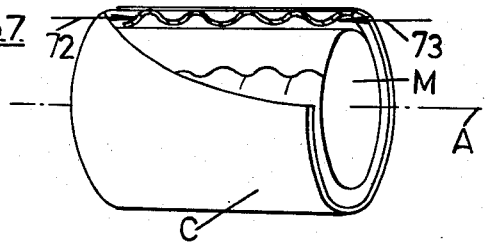
FIG. 7 is a part-sectioned perspective view of a catalytic device fabricated according to the third aspects of the invention.

FIG. 7 shows a casing C around a catalyst carrier member M. A corrugated material 91 is used with the corrugations lying perpendicular to longitudinal axis A of member M. Initially the corrugated material 91 is wrapped around the member M. After insertion in the case C the corrugated material 91 is subjected to axial compressed loading in the direction of arrows 92, 93 so that it is forced in a radial direction (both inwardly and outwardly).

Both casing C and member M are frictionally retained by contact with the compressed corrugated material 91 which thereby serves to locate the carrier member M and also to provide a peripheral gas barrier.

We claim

1. A method of fabricating a catalytic device for an exhaust system for an internal combustion engine comprises the steps of:

1. disposing a layer of thermal insulating material about the periphery of a unitary refractory catalyst support member;
2. disposing around the member and the layer a sheet of casing material;
3. contiguously juxtaposing the ends of the sheet of casing material, applying tension to the juxtaposed ends of the material to draw them away from the layered member while squeezing the tensioned ends together in the vicinity of and tangentially to the layered member to tension the sheet and compress the layer substantially uniformly; and
4. securing the sheet to itself to provide a gas tight enclosure about the member.

2. A method of fabricating a catalytic device for an exhaust system for an internal combustion engine comprises the steps of:

1. disposing a layer of thermal insulating material about the periphery of a unitary refractory catalyst support member;
2. disposing around the member and the layer a sheet of casing material having two opposite castellated ends, said ends being castellated in an off-set manner from each other;
3. interleaving the castellated ends and drawing the interleaved ends of the sheet of casing material in directions tangential to the support member to tension the sheet and compress the layer substantially uniformly; and
4. securing the sheet to itself at the intersection of said interleaved ends to provide a gas tight enclosure about the member.

3. A method of fabricating a catalytic device for an exhaust system for an internal combustion engine comprises the steps of:

1. disposing a layer of thermal insulating material about the periphery of a unitary refractory catalyst support member;
2. disposing around the member and the layer a tube of casing material;
3. forming in the wall of said tube at least a pair of parallel ribs, each said rib extending along the length of said tube between the ends thereof and being diametrically opposite to each other; and
4. uniformly deforming the ribs to tension the casing to compress the layer substantially uniformly and provide a gas tight enclosure about the member.

4. A method of fabricating a catalytic device for an exhaust system for an internal combustion engine comprises the steps of:

1. disposing a layer of thermal insulating material about the periphery of a unitary refractory catalyst support member;
2. disposing around the member and the layer a sheet of casing material;
3. securing axial edges of the casing material to a bar;
4. twisting the bar around its axis causing said sheet of casing material to wrap around the bar adjacent both of said axial edges of said casing material, thereby increasing tension in the casing and compressing the layer substantially uniformly;
5. securing the sheet to itself to provide a gas tight enclosure about the member; and
6. detaching the bar and surplus sheet material from the enclosed member.

* * * * *